US007796916B2

(12) United States Patent
Kato et al.

(10) Patent No.: US 7,796,916 B2
(45) Date of Patent: Sep. 14, 2010

(54) IMAGE FORMING APPARATUS HAVING A GUIDE FOR GUIDING AT FIRST AND/ OR SECOND IMAGE FORMING UNITS TO BE MOUNTING IN THE APPARATUS WHEN AN OPENABLE MEMBER IS OPEN

(75) Inventors: Takayuki Kato, Kashiwa (JP); Hideki Kotsuka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 12/137,281

(22) Filed: Jun. 11, 2008

(65) Prior Publication Data

US 2008/0310882 A1 Dec. 18, 2008

(30) Foreign Application Priority Data

Jun. 15, 2007 (JP) ..... 2007-158601

(51) Int. Cl.
*G03G 21/16* (2006.01)

(52) U.S. Cl. ..... 399/111; 399/114

(58) Field of Classification Search ..... 399/107, 399/110, 111, 112, 114
See application file for complete search history.

(56) References Cited

U.S. PATENT DOCUMENTS

| | | | | |
|---|---|---|---|---|
| 6,571,073 | B1 | 5/2003 | Suzuki et al. | 399/116 |
| 7,082,660 | B2 | 8/2006 | Kato et al. | 39/401.1 |
| 7,130,560 | B2 | 10/2006 | Kawai et al. | 399/110 |
| 7,139,507 | B2 | 11/2006 | Sugimura et al. | 399/111 |
| 7,155,141 | B2 | 12/2006 | Sato et al. | 399/114 |

FOREIGN PATENT DOCUMENTS

| | | |
|---|---|---|
| JP | 10-301463 | 11/1998 |
| JP | 2001-242762 | 9/2001 |
| JP | 2002-62782 | 2/2002 |
| JP | 2004-101961 | 4/2004 |
| JP | 2005-266670 | 9/2005 |
| JP | 2006-267668 | 10/2006 |

OTHER PUBLICATIONS

Korean Office Action dated Sep. 29, 2009, in counterpart Korean Application No. 10-2008-0055658.

*Primary Examiner*—Hoang Ngo
(74) *Attorney, Agent, or Firm*—Fitzpatrick, Cella, Harper & Scinto

(57) ABSTRACT

An image forming apparatus includes first and second image forming units having, respectively, first and second image bearing members, detachably mountable to a main assembly of the image forming apparatus. The apparatus also includes a transfer device transferring toner images formed on the first and second image bearing members onto a transfer medium, an opening through which the first and second image forming units are passable during mounting and demounting operations, an openable member, and a guide for guiding, during mounting and demounting, the first and/or second image forming units when the openable member is in the open position. At least a part of the guide enters a space between the first and second image forming units when the openable member is in the close position.

6 Claims, 8 Drawing Sheets

IMAGE FORMING APPARATUS HAVING A GUIDE FOR GUIDING AT FIRST AND/ OR SECOND IMAGE FORMING UNITS TO BE MOUNTING IN THE APPARATUS WHEN AN OPENABLE MEMBER IS OPEN

FIELD OF THE INVENTION AND RELATED ART

The present invention relates to an image forming apparatus, for forming an image on a recording medium, including a plurality of process cartridges (image forming units) each including at least an image bearing member on which a toner image is to be formed. For example, the process cartridges (image forming units) are used in color electrophotographic copying machines, color electrophotographic printers (such as a color laser printer and a color LED printer), etc.

A conventional image forming apparatus of this type may, e.g., include a tandem-type color electrophotographic apparatus using a plurality of image forming units for forming color component images of yellow, magenta, cyan, black, etc.

The process cartridge is prepared by integrally assembling a photosensitive member as an image bearing member and image forming process means acting on the photosensitive member into a cartridge which is detachably mountable to an apparatus main assembly of an electrophotographic image forming apparatus. The image forming process means may, e.g., include at least one of a charging means for electrically charging the photosensitive member uniformly, a developing means for developing an electrostatic latent image formed on the photosensitive member, and a cleaning means for removing a toner remaining on the photosensitive member after a transfer process. The apparatus main assembly is an image forming apparatus main assembly to which the process cartridge is to be mounted.

In Japanese Laid-Open Patent Application (JP-A) 2002-62782, as a mounting/demounting constitution of four process cartridges (photosensitive member units) with respect to the apparatus main assembly, the following constitution is described. All the four process cartridge are supported by a common holding (supporting) member which is vertically movable in interrelation with a rotational movement operation of an operating lever. Then, in interrelation with the rotational movement operation, the holding member is moved to move all the four process cartridges between an image forming portion and a mounting/demounting portion.

In JP-A 2005-266670 and JP-A Hei 10-301463, such a constitution that a small cover as a means for improving an exchanging operability of a process cartridge is used as a guide for guiding a bottom portion of the process cartridge is described.

The recent years, in order to increase productivity, such a constitution that a plurality of process cartridges for several colors is arranged in a line so that a color image is formed by successively transferring toner images of respective colors formed on respective photosensitive members onto an intermediary transfer belt in a superposition manner (in-line type image forming apparatus) is employed. In this constitution, it is necessary to perform downsizing with respect to a width direction of an image forming apparatus in order to arrange the process cartridges in the width direction. That is, the distance between a first contact portion at which a photosensitive member and an intermediary transfer belt contact each other and a second contact portion at which a second photosensitive member and the intermediary transfer belt contact each other is required to be decreased. As a result, the distance between adjacent process cartridges is decreased.

As a result of the decrease in the distance between the first and second contact portions (of the respective photosensitive members with the intermediary transfer belt), a space in which a guiding member for guiding a process cartridge in an appropriate attitude in the apparatus main assembly during insertion of the process cartridge is disposed cannot be ensured. For that reason, such a constitution that a guide portion for ensuring a portion and an attitude of a process cartridge during start of insertion of the process cartridge is provided above an openable member for covering an inserting opening of the process cartridge has been conventionally considered.

In order to improve an attitude retaining force, a rectifying force, and viewability (how and where to dispose the process cartridge) of the process cartridge, it is preferable that the guide portion is high. However, in the case where a high guide portion is provided to an openable member, when the openable member is closed, there is a possibility that the guide portion strikes against an inner portion of an image forming apparatus. Therefore, in order not to cause the strike of the guide portion even when the openable member is closed, when the distance between the openable member and the inner portion of the image forming apparatus is ensured, there has arisen such a problem that the width of the image forming apparatus is increased in an amount corresponding to the distance.

SUMMARY OF THE INVENTION

A principal object of the present invention is to provide an image forming apparatus capable of increasing a guide portion in height without impairing downsizing of the image forming apparatus.

According to an aspect of the present invention, there is provided an image forming apparatus comprising first and second image forming units, a transfer device, an opening, an openable member, and a guide portion. The first image forming unit comprises a first image bearing member on which a toner image is to be formed, and is detachably mountable to a main assembly of the image forming apparatus. The second image forming unit comprises a second image bearing member on which a toner image is to be formed, and is detachably mountable to the main assembly of the image forming apparatus in a position adjacent to the first image forming unit mounted in the main assembly of the image forming apparatus. The transfer device transfers the toner image formed on the first image bearing member and the toner image formed on the second image bearing member onto a transfer medium. The opening is an opening through which the first image forming unit and the second image forming unit are passable during mounting and demounting operations. The openable member is movable to an open position and a close position so as to open and close the opening. The guide portion is provided to the openable member, and guides at least one of the first image forming unit and the second image forming unit to be mounted in the main assembly when the openable member is located in the open position. The guide portion is provided so that at least a part of the guide portion enters a space between the first image forming unit mounted in the main assembly of the image forming apparatus and the second image forming unit mounted in the main assembly of the image forming apparatus when the openable member is located in the close position.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described in detail with reference to the drawings. It should be understood that dimensions, materials, shapes, relative arrangements of constituent elements of the image forming apparatus according to the present invention are not limited to those described in the following embodiments unless otherwise specified.

Figure 1:
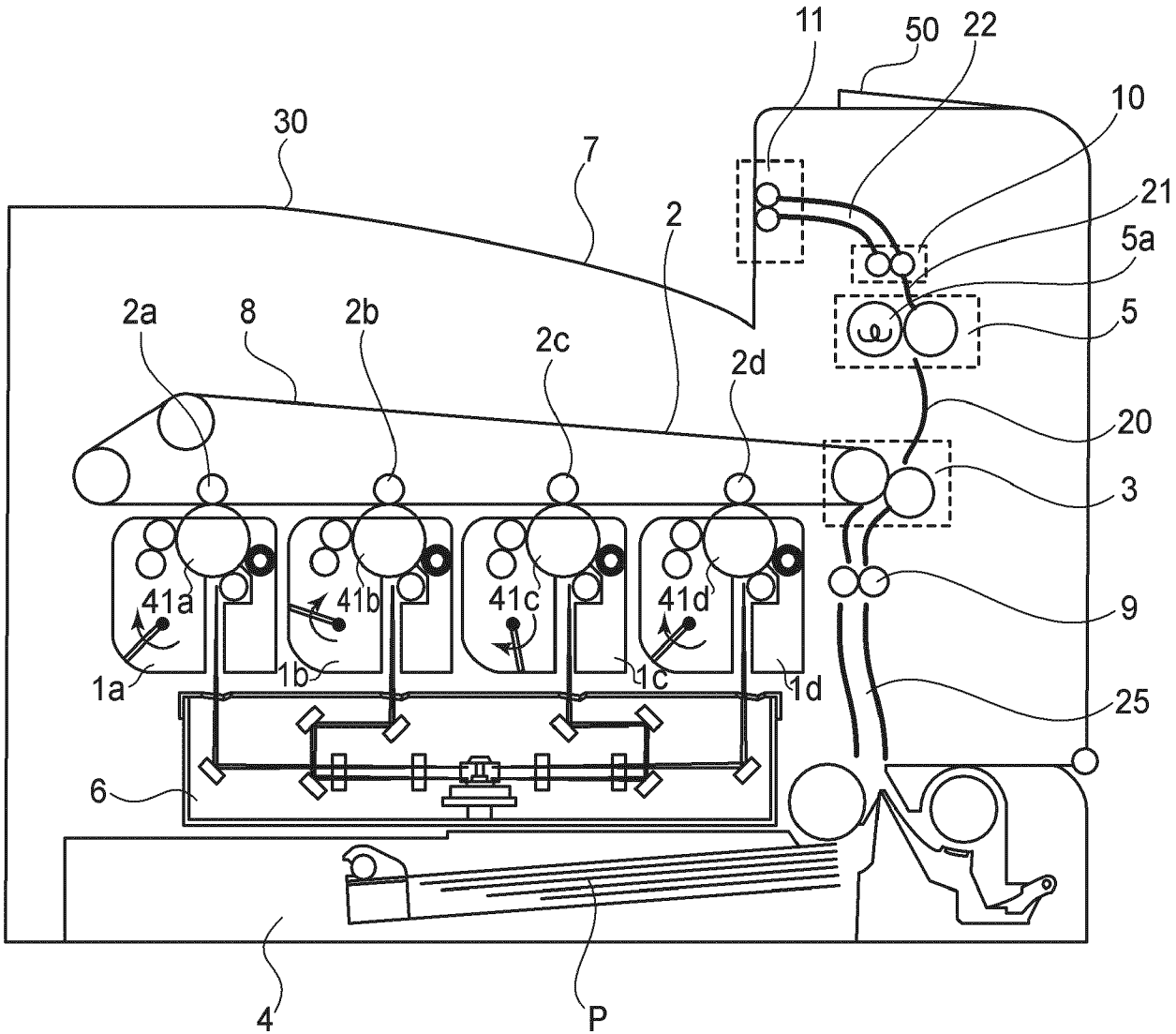
FIG. 1 is a schematic front view of an image forming apparatus according to an embodiment of the present invention.
Figure 2:
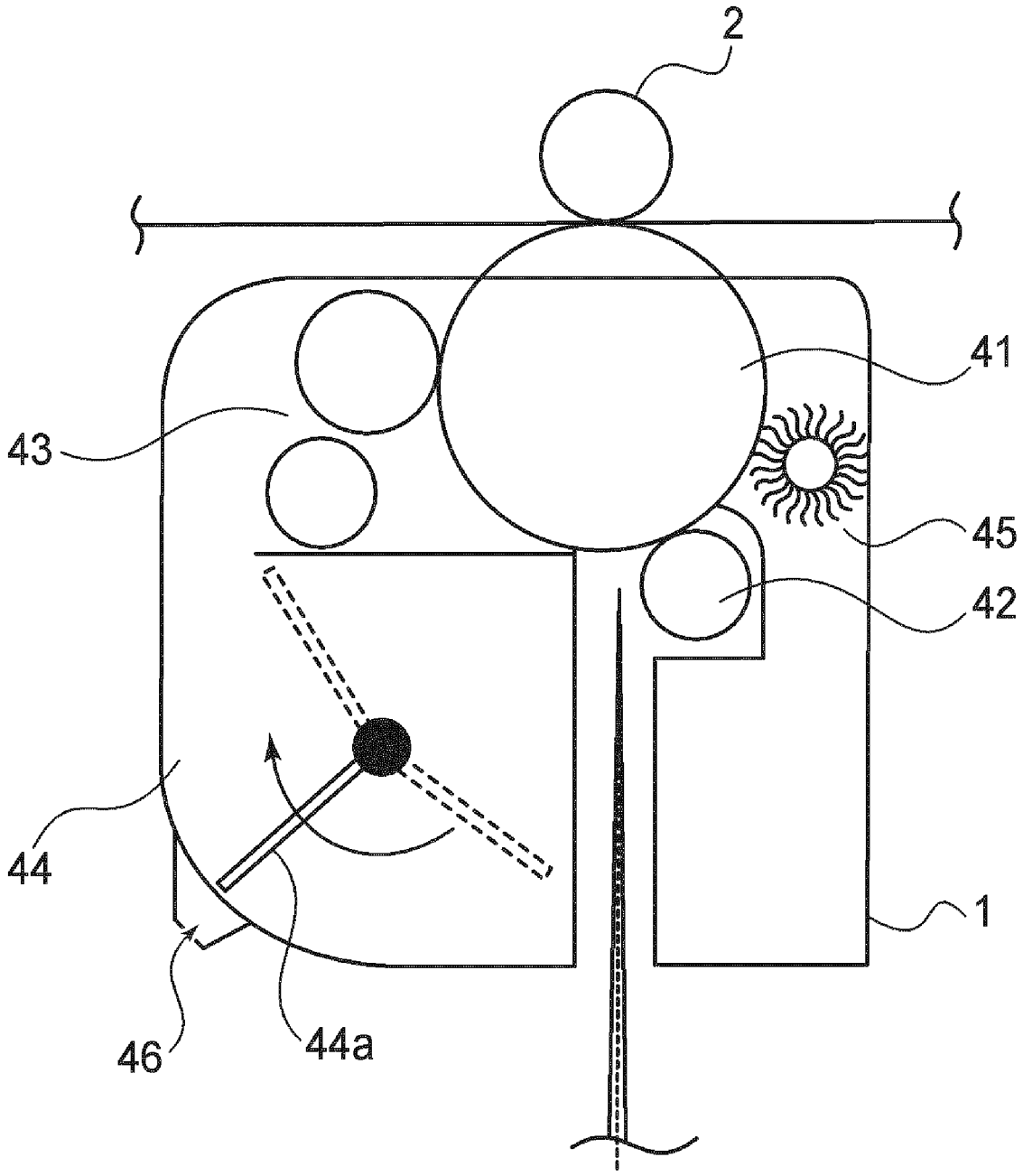
FIG. 2 is a schematic enlarged view of a process cartridge according to an embodiment of the present invention.

FIG. 1 is a schematic view showing an embodiment of a full-color image forming apparatus (a full-color printer) which employs a conventional electrophotographic process and includes an intermediary transfer belt (a belt member) as a transfer medium. FIG. 2 is a schematic enlarged view of a peripheral portion of a process cartridge used in this image forming apparatus.

The image forming apparatus includes a process cartridge 1*a* for forming an image of yellow, a process cartridge 1*b* for forming an image of magenta, a process cartridge 1*c* for forming an image of cyan, and a process cartridge 1*d* for forming an image of black. In this embodiment, these process cartridges are used as image forming units. These four process cartridges 1*a*, 1*b*, 1*c* and 1*d* are arranged in a line at regular intervals. In the process cartridges 1*a*, 1*b*, 1*c* and 1*d*, drum-type electrophotographic photosensitive members 41*a*, 41*b*, 41*c* and 41*d*, each as an image bearing member (hereinafter referred to as "photosensitive drum(s)") are provided, respectively. Each of the process cartridges 1*a*, 1*b*, 1*c* and 1*d* is configured to be independently detachably mountable to an apparatus main assembly with respect to a front-rear direction of the apparatus main assembly.

Referring to FIG. 2, around each photosensitive drum 41, a primary charger 42 as a charging member, a developing device 43 as a developing means, a transfer roller 2 (2*a*, 2*b*, 2*c* and 2*d* in FIG. 1) as a transfer means, and a cleaner 45 as a cleaning means are disposed. Below each developing device 43, a toner accommodating portion 44 in which a toner is accommodated is provided and to the toner accommodating portion 44, a remaining toner amount detecting member 46 is provided.

The photosensitive drum 41 is a negatively chargeable OPC photosensitive member and includes a drum base member of aluminum and a photoconductive layer disposed on the drum base member. The photosensitive drum 41 is rotationally driven at a predetermined process speed by a driving device (not shown).

The primary charger 42 as a primary charging means electrically uniformly charges a surface of an associated photosensitive drum 41 to a predetermined negative potential by a charging bias applied from a charging bias voltage source (not shown).

Referring to FIG. 1, below the process cartridges 1*a*, 1*b*, 1*c* and 1*d*, a laser exposure device 6 is disposed. The exposure device 6 is constituted by a laser light emitting means for emitting light corresponding to a time-series electric digital pixel signal of given image information, a polygonal lens, a reflection mirror, etc. The laser exposure device 6 forms electrostatic latent images of respective colors corresponding to image information on the photosensitive drums 41*a*, 41*b*, 41*c* and 41*d*, respectively, electrically charged by the respective primary chargers 42 by subjecting the respective photosensitive drums 41*a*, 41*b*, 41*c* and 41*d* to light exposure.

The developing device 43 develops each electrostatic latent image into a toner image by depositing an associated color toner on the electrostatic latent image formed on an associated photosensitive drum 41.

In the toner accommodating portion 44, a toner stirring member 44*a* is provided. The toner stirring member 44*a* is constituted by a sheet-like member extending in the entire area with respect to a front-rear direction on the drawing of FIG. 2. The toner stirring member 44*a* is rotated in a direction indicated by an arrow (FIG. 2) by an unshown driving means, so that the toner in the toner accommodating portion 44 is sent to the developing device 43. The remaining toner amount detecting member 46 includes an optical detecting element by which the presence or absence of the toner in the toner accommodating portion 44 is detected.

The transfer rollers 2*a*, 2*b*, 2*c* and 2*d* as the primary transfer means are disposed so that these rollers are press-contactable with the respective photosensitive drums 41*a*, 41*b*, 41*c* and 41*d*, respectively, by the medium of the intermediary transfer belt 8 as the transfer medium. By these transfer rollers, the toner images on the respective photosensitive drums are transferred onto the intermediary transfer belt 8.

The cleaner 45 includes a fur brush or a cleaning blade for removing a transfer residual toner, remaining on the photosensitive drum 41 after primary transfer, from the photosensitive drum 41.

The intermediary transfer belt 8 is constituted by a dielectric resin material such as a polycarbonate film, a polyethylene terephthalate (resin) film, or a polyvinylidene fluoride (resin) film. In this embodiment, with respect to a vertical direction of the image forming apparatus, the process cartridges for the respective colors are disposed below the intermediary transfer belt 8.

At a secondary transfer portion 3, a secondary transfer opposite roller is disposed so that it is press-contactable with a secondary transfer roller by the medium of the intermediary transfer belt 8. The toner images superposed on the intermediary transfer belt 8 are transferred at the secondary transfer portion 3 onto a recording material P conveyed to the secondary transfer portion 3.

Further, at a portion downstream from and above the secondary transfer portion 3 with respect to a conveyance direction of the recording material P, a fixing device 5 including a fixing roller and a pressing roller is disposed. A substantially vertical conveying path is formed between the secondary transfer portion 3 and the fixing device 5. The toner images transferred onto the recording material P at the secondary transfer portion 3 are fixed on the recording material P under the application of heat and pressure by the fixing device 5.

Next, an image forming operation by the above-described image forming apparatus will be described similarly with reference to FIGS. 1 and 2.

When an image formation start signal is provided, each of the photosensitive drums 41*a*, 41*b*, 41*c* and 41*d*, of the process cartridges 1*a*, 1*b*, 1*c* and 1*d*, rotationally driven at a predetermined process speed, is negatively charged uniformly by an associated primary charger 42. Then, the exposure device 6 emits laser light, corresponding to a color-separated image signal inputted from external equipment, from a laser emitting element, so that an electrostatic latent image of each color is formed on an associated photosensitive drum 41*a*, 41*b*, 41*c* or 41*d* by the laser light exposure through the polygonal lens, the reflection mirror, etc.

Then, first, on the electrostatic latent image formed on the photosensitive drum 41*a*, a yellow toner is deposited by the developing device 43 to which a developing bias (voltage) of an identical polarity to a charge polarity (negative polarity) of the photosensitive drum 41*a* is applied, so that the electrostatic latent image is visualized as a yellow toner image. This yellow toner image is then primary-transferred onto a driven intermediary transfer belt 8 at the primary transfer portion between the photosensitive drum 41*a* and the transfer roller 2*a* by the transfer roller 2*a* to which a primary transfer bias (of a (positive) polarity opposite to the charge polarity of the toner) is applied.

The intermediary transfer belt 8 onto which the yellow toner image is transferred is moved toward the process cartridge 1*b*. Then, also in the process cartridge 1*b*, similarly as in the above described manner, a magenta toner image formed on the photosensitive drum 41*b* is superposed and transferred onto the yellow toner image on the intermediary transfer belt 8 at an associated primary transfer portion.

Then, transfer residual toner remaining on each photosensitive drum 41 is scraped off the photosensitive drum 41 by the fur brush or the like provided in the drum cleaning device 45, thus being collected.

Thereafter, in a similar manner, on the yellow and magenta toner images transferred onto the intermediary transfer belt 8 in a superposition manner, a cyan toner image and a black toner image formed on the photosensitive drums 41*c* and 41*d* of the process cartridges 1*c* and 1*d*, respectively, are successively superposed at the respective primary transfer portions. Thus, full-color toner images are formed on the intermediary transfer belt 8.

In synchronism with timing at which a leading end of the toner images on the intermediary transfer belt 8 is moved to the secondary transfer portion 3, the recording material P fed from a sheet feeding cassette 4 or a manual feeding tray through a feeding path 25 is conveyed to the secondary transfer portion 3 by registration rollers 9. Onto the recording material P conveyed to the secondary transfer portion 3, the full-color toner images are secondary-transferred simultaneously by the secondary transfer roller to which a secondary transfer bias (of a (positive) polarity opposite to the charge polarity of the toner) is applied.

The recording material P on which the full-color toner images are formed is conveyed to the fixing device 5, in which the full-color toner images are heated and pressed in a fixing nip between the fixing roller and the pressing roller to be heat-fixed on a surface of the recording material P. Thereafter, the recording material P is discharged on a sheet discharge tray 7 at an upper surface of the apparatus main assembly by sheet discharging rollers 11, so that a series of image forming operations is completed. Incidentally, secondary transfer residual toner or the like remaining on the intermediary transfer belt 8 is removed and collected by an unshown cleaning device.

FIG. 2 shows a structure of the process cartridge in a state in which the process cartridge is mounted in the image forming apparatus. On the photosensitive drum 41 side in the process cartridge, i.e., at an upper portion of FIG. 2, a space is horizontally occupied principally by devices concerning the image forming process including the charging device 42, the cleaner (cleaning device) 45 and the developing device 43. On the other hand, on the side below the photosensitive drum 41, i.e., at a lower portion of FIG. 2, a substantially arcuate concave portion (having such a shape that it extends downwardly away from an opposing surface of an adjacent process cartridge) is provided at a lower left portion of a side surface (wall) of the toner accommodating portion 44. This is attributable to the following reasons. As in this embodiment, in such a constitution that the process cartridge is disposed below the intermediary transfer belt 8 with respect to the vertical direction of the image forming apparatus, the photosensitive drum is disposed in an uppermost position with respect to the vertical direction in order that the intermediary transfer belt and the photosensitive drum contact each other. A developing sleeve (developer carrying member) of the developing means is required to be adjacent to the photosensitive drum. Further, in such a constitution that a distance between contact portions of the photosensitive drum and the intermediary transfer belt is decreased, the toner accommodating portion is located on a lower side than the photosensitive drum in the process cartridge. The toner accommodating portion is required to be disposed in a rotatable range of the toner stirring member in order that the toner in the lower toner accommodating portion is conveyed to the upper developing sleeve. For that reason, the shape of the toner accommodating portion disposed on the lower side of the process cartridge is inevitably a substantially arcuate shape with a point, substantially identical to a rotation shaft of the toner stirring member 44*a*, as a center. For these reasons, in the case where the plurality of the process cartridges 1 is arranged in parallel, a space between adjacent process cartridges is small on the photosensitive drum side (the upper side of FIG. 2) and large on the toner accommodating portion side (the lower side of FIG. 2). That is, on the lower side than the photosensitive drums of the first process cartridge (first image forming unit) and the second process cartridge (second image forming unit), it is possible to form the (large) space without increasing the distance between the photosensitive drums.

Further, with respect to the toner accommodating portion side (the lower side of FIG. 2), as described above, the remaining toner amount detecting member 46 is provided. This detecting member 46 is provided in the above-described space so that it is projected from the toner accommodating portion of the process cartridge at a substantially central portion with respect to a longitudinal direction of the process cartridge.

Figure 3:
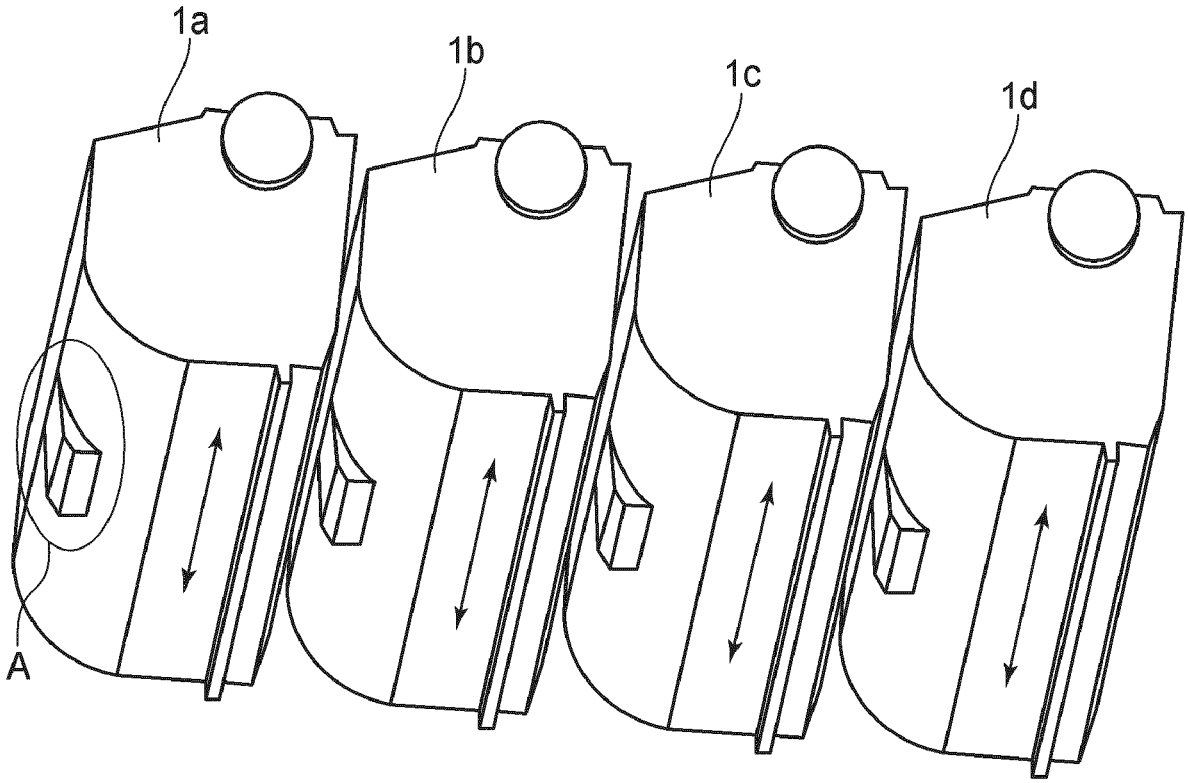
FIG. 3 is a schematic perspective view of process cartridges according to an embodiment of the present invention.

FIG. 3 is a schematic perspective view of an outer shape of the parallel-arranged process cartridges 1*a*, 1*b*, 1*c* and 1*d* as seen from below the process cartridges. In a projected portion (A in FIG. 3) provided at the lower left portion (FIG. 2) of the process cartridge 1, the above-described remaining toner amount detecting member 46 (FIG. 2) is provided. It is necessary to efficiently perform stirring by the toner stirring member 44*a* and to increase a toner accommodating volume of the toner accommodating portion with maximum efficiency. For that reason, the inner wall shape of the toner accommodating portion 44 is, as described above, required to be configured so that the substantially arcuate shape extends over the entire longitudinal area with the rotation shaft of the toner stirring member 44*a* as the center. For this reason, the projected portion A by the remaining toner amount detecting member 46 is provided. However, it is impossible for an adjacent process cartridge to occupy a portion other than the thus provided projected portion A when the insertion and extraction of the process cartridge is taken into consideration. More specifically, the process cartridges 1 are required to be independently inserted and extracted for each color, so that the outer shape of the adjacent process cartridge cannot interfere with that of an associated process cartridge with respect to an insertion/extraction direction (indicated by double-pointed arrows in FIG. 3). Thus, with respect to front and rear directions of the projected portion A, a space is inevitably created.

Next, an exchanging operation of the process cartridge of this image forming apparatus will be described.

Figure 4:
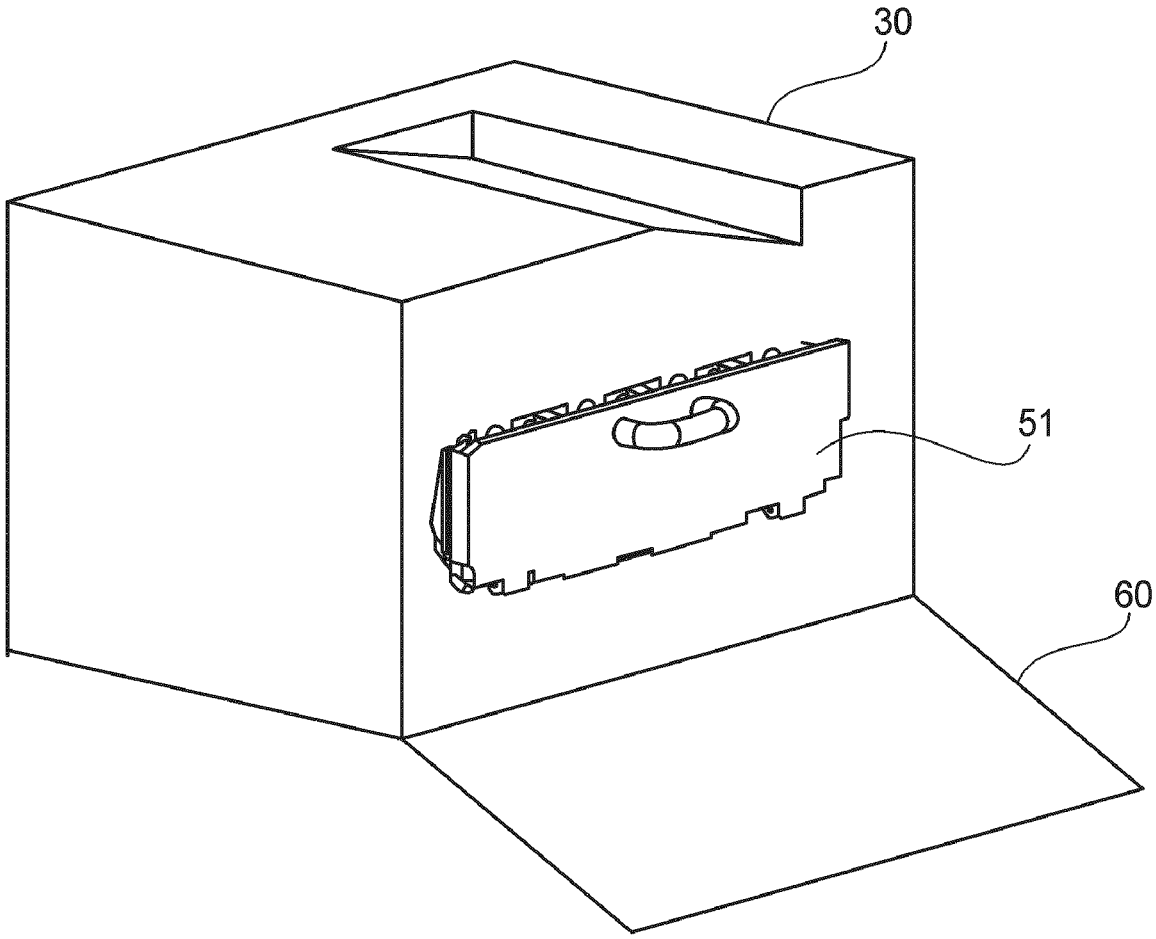
FIGS. 4, 5 and 6 are schematic perspective views each of an apparatus main assembly according to an embodiment of the present invention.
Figure 5:
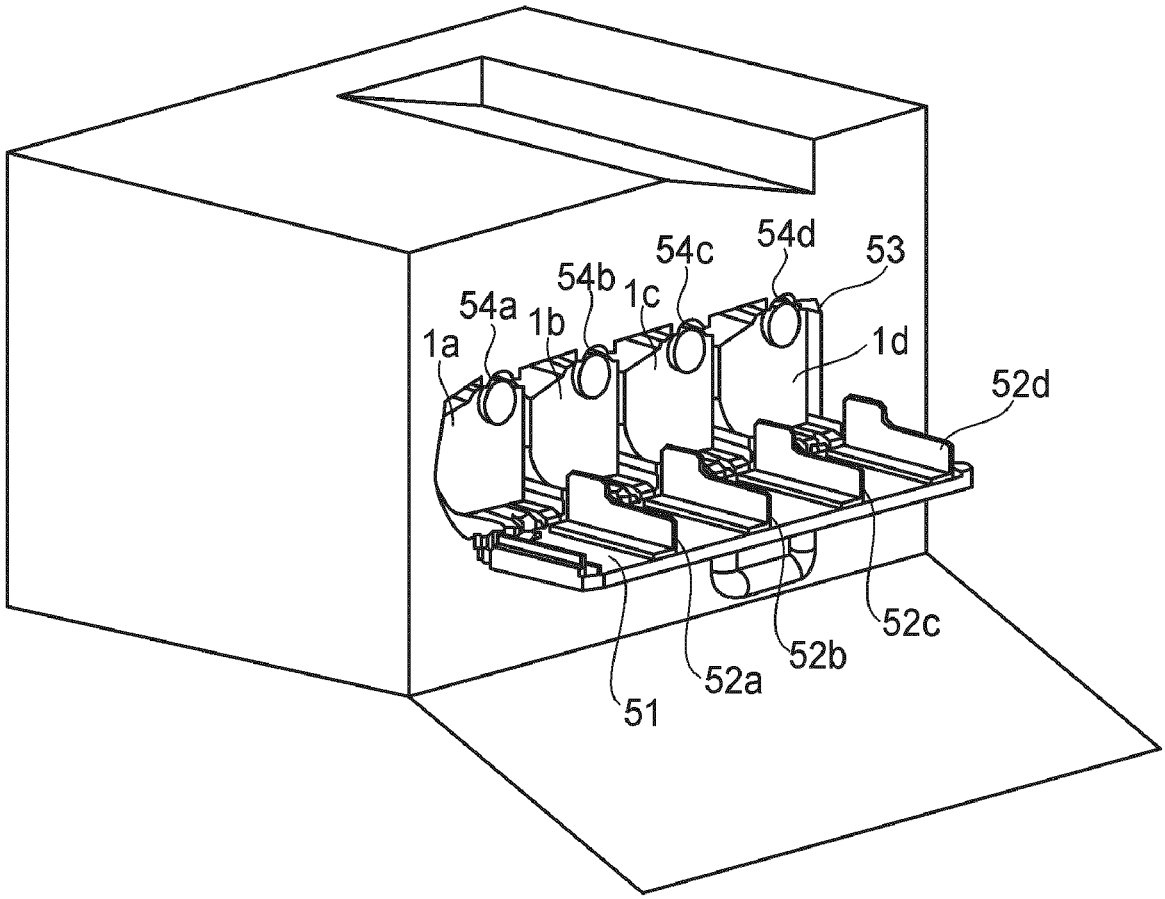
Figure 6:
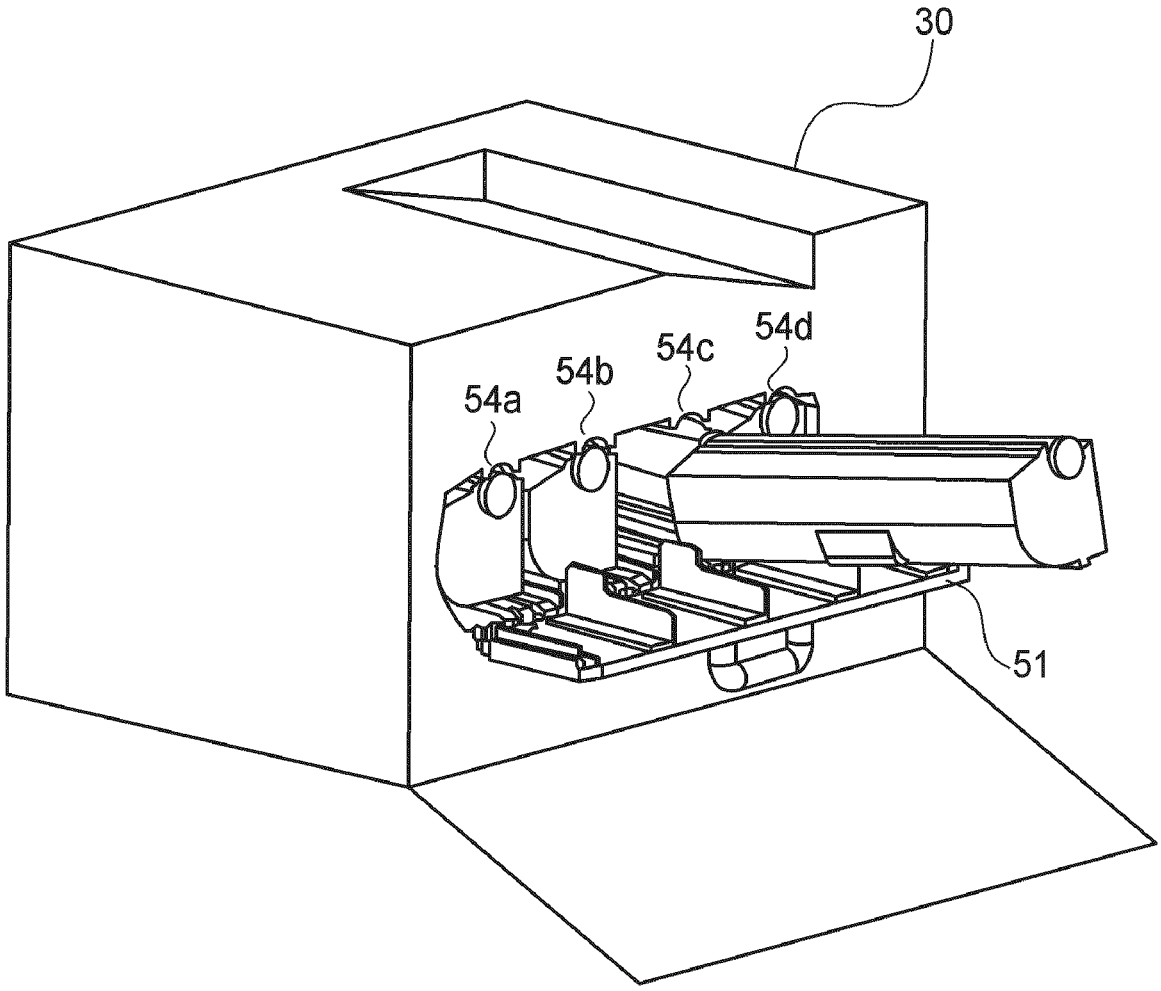

FIGS. 4, 5 and 6 are schematic perspective views of the entire image forming apparatus for illustrating the exchanging operation of the process cartridge with respect to the apparatus main assembly.

FIG. 4 shows such a state that a main assembly door (front cover) 60 of an image forming apparatus 30 in which the process cartridges 1*a*, 1*b*, 1*c* and 1*d* are mounted is opened. An inserting opening 53 (FIG. 5), provided at a side surface of the apparatus main assembly, for the process cartridges 1*a*, 1*b*, 1*c* and 1*d* is covered with an openable cover 51 as an openable member. The openable cover 51 is provided at a side surface portion of the main assembly of the image forming apparatus.

FIG. 5 shows a state in which the openable cover 51 is opened and the process cartridges 1*a*, 1*b*, 1*c* and 1*d* can be dismounted through the inserting opening 53. As understood from FIG. 5, in this embodiment, a single opening for mounting and demounting the plurality of process cartridges provided to the image forming apparatus is provided in order to decrease the distance between adjacent contact portions each between an associated photosensitive drum and the intermediary transfer belt.

FIG. 6 shows a state in which the process cartridge 1*c* is demounted from the apparatus main assembly placed in the state of FIG. 5.

When the process cartridges 1*a*, 1*b*, 1*c* and 1*d* are mounted, a mounting operation is performed in reverse order to the order described above, i.e., the order of FIG. 6, FIG. 5 and FIG. 4.

The process cartridges 1*a*, 1*b*, 1*c* and 1*d* are vertically moved in interrelation with an opening/closing operation of the openable cover 51. That is, after the process cartridges are mounted in the image forming apparatus, in interrelation with a closing operation of a lever or the openable cover 51, the process cartridges are upwardly moved from the mounting position toward an image formable position. Specifically, rails on the apparatus main assembly side for supporting lower portions of the process cartridges 1*a*, 1*b*, 1*c* and 1*d* are moved up and down in interrelation with the openable cover 51. When the openable cover 51 is closed, the process cartridges 1*a*, 1*b*, 1*c* and 1*d* are moved up and when the openable cover 51 is opened, the process cartridges 1*a*, 1*b*, 1*c* and 1*d* are moved down. This is because the photosensitive drums are required to contact the intermediary transfer belt during image formation and therefore there is a possibility of damage to the intermediary transfer belt when the mounting and demounting operations of the process cartridges are performed at a position identical to that during the image formation. In this embodiment, the process cartridges are vertically moved but the intermediary transfer belt may also be configured to be vertically moved. When the process cartridges 1*a*, 1*b*, 1*c* and 1*d* are moved up, these process cartridges strike against abutting portions 54*a*, 54*b*, 54*c* and 54*d* on the apparatus main assembly side (FIG. 5), so that the process cartridges 1*a*, 1*b*, 1*c* and 1*d* are portioned and fixed in the apparatus main assembly. On the other hand, when the process cartridges 1*a*, 1*b*, 1*c* and 1*d* are moved down, the process cartridges 1*a*, 1*b*, 1*c* and 1*d* are separated from the abutting portions 54*a*, 54*b*, 54*c* and 54*d*. Thus, the process cartridges are placed in such a state that the process cartridges are only mounted on the rails on the apparatus main assembly side, so that the process cartridges are demountable to enable the exchanging operation.

As described above in this embodiment, the single opening for mounting and demounting the plurality of process cartridges is employed, so that when the process cartridges are mounted, the number of guide portions which can be provided in the image forming apparatus is decreased. As a result, there is a possibility that a user inserts the process cartridges into the image forming apparatus main assembly with an improper (erroneous) attitude when the user mounts the process cartridges in the apparatus main assembly. For this reason, from the viewpoint of usability, it is necessary to newly provide guide portions.

Figure 7:
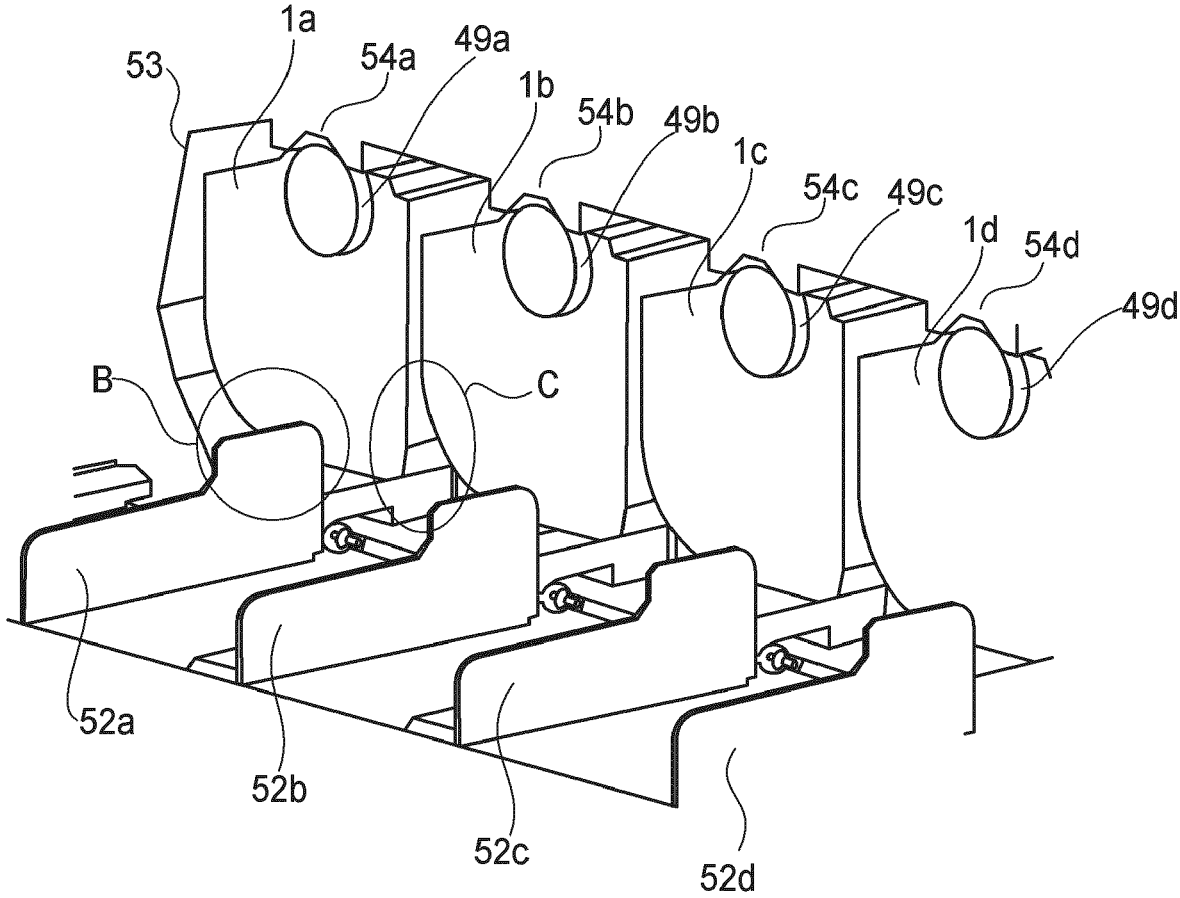
FIGS. 7, 8 and 9 are schematic enlarged perspective views each of a process cartridge inserting portion according to an embodiment of the present invention.

In this embodiment, these new guide portions are provided at an inner surface of the openable cover. Referring to FIG. 7, the inner surface of the openable cover 51 (an upper surface in an opened state of the openable cover 51) functions as a guiding surface at the time of inserting the process cartridges 1*a*, 1*b*, 1*c* and 1*d*. To this guiding surface, guiding ribs 52*a*, 52*b*, 52*c* and 52*d*, which are projected guide portions, are provided. These guiding ribs 52*a*, 52*b*, 52*c* and 52*d* are formed so as to guide side surfaces of the respective process cartridges 1*a*, 1*b*, 1*c* and 1*d* in the insertion direction and are each configured to have a higher portion (B in FIG. 7) closest to the inserting opening 53. That is, on the rotational center shaft side of the openable cover, the higher portions of the guide portions are located. The portion B closest to the inserting opening 53 is high, so that the process cartridge 1 can easily be guided to a predetermined portion and a predetermined attitude immediately before start of insertion of the process cartridge 1. Further, as shown in FIG. 7, in the case where the process cartridges 1*a*, 1*b*, 1*c* and 1*d* are arranged side by side and the distance between adjacent process cartridges is small, the inserting opening 53 for the process cartridges inevitably constitutes a single large hole (opening). In the image forming apparatus having such a large inserting opening, a greater effect of rectifying the portion and attitude of the process cartridges is achieved by the higher B portions closest to the inserting opening.

Each of the guiding ribs 52*a*, 52*b*, 52*c* 52*d* is provided so that at least one of adjacent two process cartridges is guided during mounting.

Next, an operational relationship among the guiding ribs 52*a*, 52*b*, 52*c* and 52*d* and the process cartridges 1*a*, 1*b*, 1*c* and 1*d* during the opening/closing operation of the openable cover 51 will be described with reference to FIGS. 7, 8 and 9, FIGS. 7, 8 and 9 being schematic enlarged perspective views each showing a neighborhood of the process cartridge inserting opening.

Figure 8:
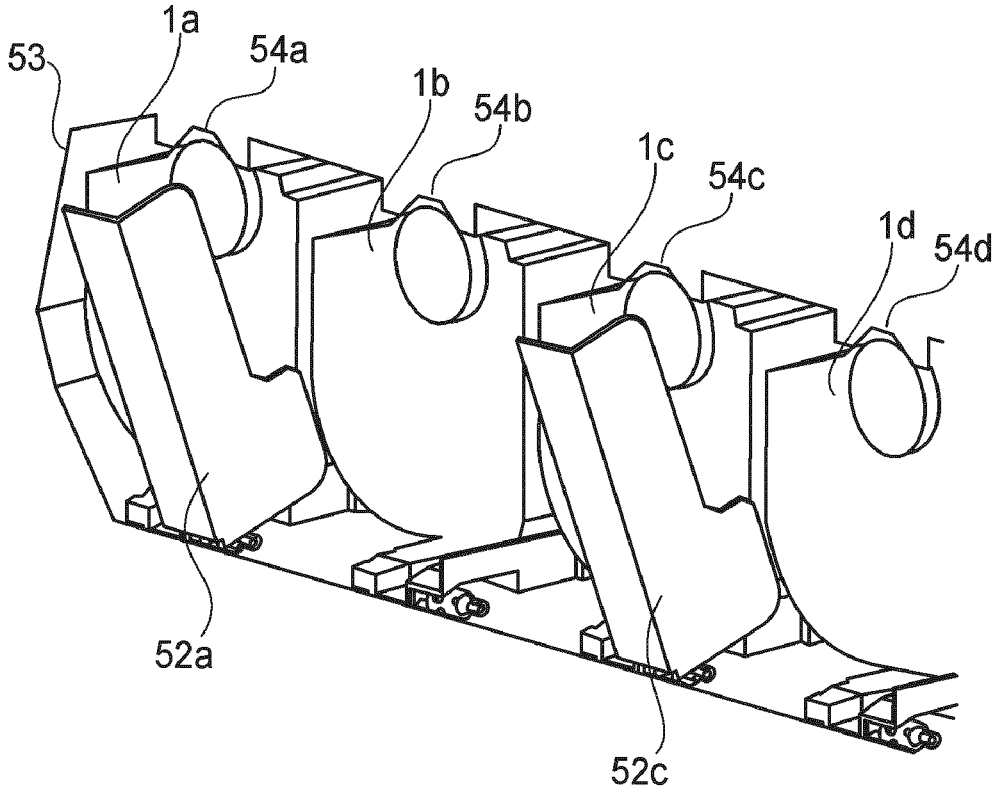
Figure 9:
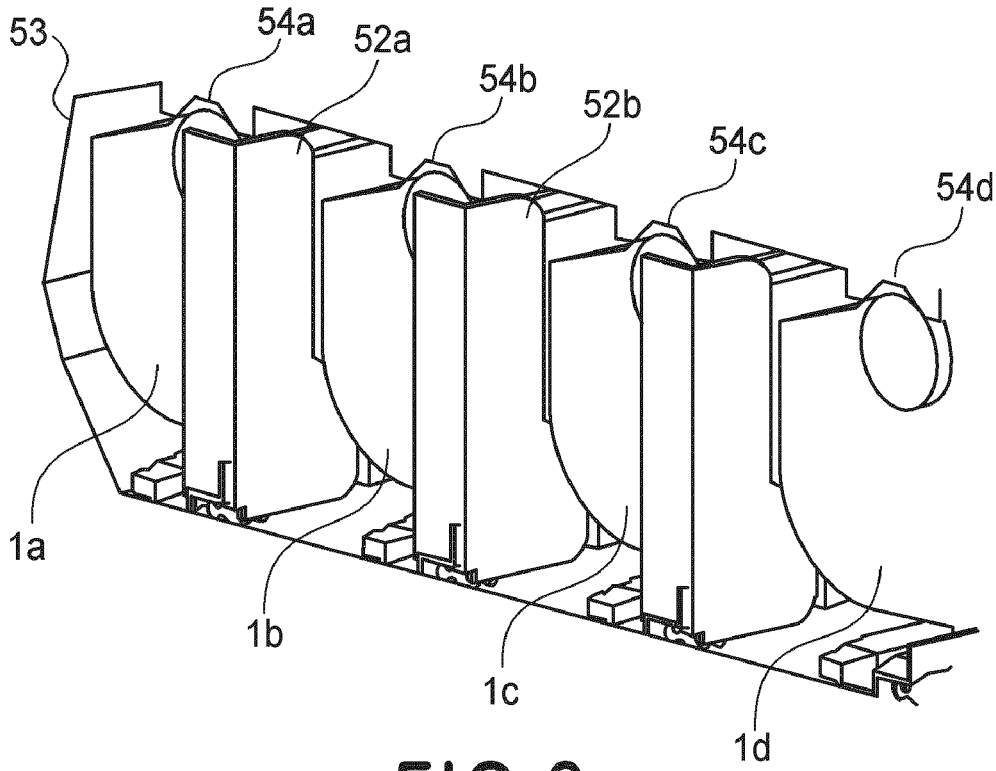

By the closing operation of the openable cover 51 from a state in which the process cartridges are accommodated in the apparatus main assembly (FIG. 7), the higher portions B of the guiding ribs 52 are accommodated in spaces (C in FIG. 7) each between adjacent two process cartridges (FIG. 8 and FIG. 9). That is, a part of each guiding rib is configured to enter the space C. This space C is located in a portion lower than a portion of each of the photosensitive drums 41*a*, 41*b*, 41*c* and 41*d*. At this time (FIG. 9), as described above, as a result of upward movement, the process cartridges strike against the abutting portions 54*a*, 54*b*, 54*c* and 54*d* to be positioned. In this case, portions contacting the abutting portions 54*a*, 54*b*, 54*c* and 54*d* are bearing portions 49*a*, 49*b*, 49*c* and 49*d* for rotationally supporting the photosensitive drums (FIG. 7).

Each of the spaces C is the above-described space created by the substantially arcuate portion located at the lower left portion of the process cartridge 1 (FIGS. 2 and 3) and is a space created by upward movement of the process cartridge 1.

Thus, the higher portions B of the guiding ribs are accommodated in the spaces C between adjacent process cartridges, so that a position of the openable cover 51 during the closing of the openable cover 51 can be brought at close as possible to the process cartridges 1. As a result, it is possible to reduce the size of the apparatus main assembly with respect to the front-rear direction of the apparatus main assembly, so that combined with downsizing with respect to a lateral direction of the apparatus main assembly by minimizing the distance between adjacent process cartridges, this size reduction largely contributes to downsizing of the entire image forming apparatus.

In this embodiment, the guide portions of the openable member are configured to have partially higher portions close to the mounting portions of the image forming units but there is no problem even when the guide portions have no lower portions. Further, the entire guide portions are not required to be higher with respect to the image forming unit mounting direction but there is no problem even when a part of each guide portion is lower with respect to the image forming unit mounting direction.

Further, the guide portions of the openable member guide the side surfaces of the image forming units but there is no problem even when additional guide portions for guiding bottom (lower) surfaces of the image forming units are provided in addition to the guide portions.

As described hereinabove, according to the present invention, even when the guide portions provided to the openable member are partially increased in height, it is possible to accommodate the guide portions in the spaces among the image forming units without increasing the distance between adjacent contact portions each between the image bearing member and the belt member.

Further, in this embodiment, a description has been provided by taking the intermediary transfer belt as an example of the transfer medium, but the present invention is not limited thereto. For example, the present invention is also applicable to even a constitution in which toner images formed on the respective photosensitive drums are directly transferred successively onto the recording material as the transfer medium without using the intermediary transfer belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 158601/2007 filed Jun. 15, 2007, which is hereby incorporated by reference.

What is claimed is:

1. An image forming apparatus comprising:

a first image forming unit, comprising a first image bearing member on which a toner image is to be formed, detachably mountable to a main assembly of said image forming apparatus;

a second image forming unit, comprising a second image bearing member on which a toner image is to be formed, detachably mountable to the main assembly of said image forming apparatus in a position adjacent to said first image forming unit mounted in the main assembly of said image forming apparatus;

a transfer device that transfers the toner image formed on said first image bearing member and the toner image formed on said second image bearing member onto a transfer medium;

an opening through which said first image forming unit and said second image forming unit are passable during mounting and demounting operations;

an openable member movable to an open position and a close position so as to open and close said opening; and a guide portion, provided to said openable member, that guides at least one of said first image forming unit and said second image forming unit to be mounted in the main assembly when said openable member is located in the open position, wherein said guide portion is provided so that at least a part of said guide portion enters a space between said first image forming unit mounted in the main assembly of said image forming apparatus and said second image forming unit mounted in the main assembly of said image forming apparatus when said openable member is located in the close position.

2. An apparatus according to claim 1, wherein said guide portion has a higher portion and a lower portion in a state in which said openable member is located in the open position, wherein the position of said lower portion is different from the position of said higher portion with respect to an image forming unit insertion direction in which at least one of said first and second image forming units is inserted through said opening toward a mounting position in the main assembly of said image forming apparatus in a state in which said openable member is located in the open position, and wherein said higher portion enters the space when said openable member is located in the close position.

3. An apparatus according to claim 1, wherein said openable member is rotatable about a rotational shaft, and wherein said guide portion is configured and positioned to have a higher portion and a lower portion, lower than said higher portion, wherein said higher portion is closer to said opening than said lower portion when said openable member is located in the open portion.

4. An apparatus according to claim 3, wherein said second image forming unit comprises a developing device that supplies a toner to said second image bearing member in a position adjacent to said first image forming unit, and wherein said developing device has such a shape that it extends downwardly away from an opposing surface of said first image forming unit.

5. An apparatus according to claim 4, wherein the transfer medium is provided above said first image bearing member and said second image bearing member, and wherein said first image forming unit and said second image forming unit move downward when said openable member rotationally moves toward the open position and move upward when said openable member rotationally moves toward the close position.

6. An apparatus according to claim 1, wherein the space where said guide portion enters is located at a portion of said apparatus lower than said first image bearing member and said second image bearing member.

* * * * *